United States Patent [19]

Cormier

[11] Patent Number: 5,077,550

[45] Date of Patent: Dec. 31, 1991

[54] BURNER FLAME SENSING SYSTEM AND METHOD

[75] Inventor: Kenneth C. Cormier, Billerica, Mass.

[73] Assignee: Allen-Bradley Company, Inc., Milwaukee, Wis.

[21] Appl. No.: 584,690

[22] Filed: Sep. 19, 1990

[51] Int. Cl.[5] ..... G08B 17/12

[52] U.S. Cl. ..... 340/578; 250/554; 431/69; 431/79

[58] Field of Search ..... 340/578; 431/79, 69; 250/554; 364/551.01, 554

[56] References Cited

U.S. PATENT DOCUMENTS

| | | | |
|---|---|---|---|
| 2,748,846 | 6/1956 | Smith et al. | 431/25 |
| 2,762,033 | 9/1956 | Krueger | 340/578 |
| 3,689,773 | 9/1972 | Wheeler | 250/554 |
| 3,716,717 | 2/1973 | Scheidweiler et al. | 250/554 |
| 3,936,648 | 2/1976 | Cormault et al. | 250/554 |
| 3,940,753 | 2/1976 | Muller | 340/578 |
| 4,233,596 | 11/1980 | Okamoto et al. | 340/578 |
| 4,370,557 | 1/1983 | Axmark et al. | 250/554 |
| 4,410,266 | 10/1983 | Seider | 356/45 |
| 4,553,031 | 11/1985 | Cholin et al. | 250/339 |
| 4,553,834 | 8/1985 | McCormack | 250/554 |
| 4,665,390 | 5/1987 | Kern et al. | 340/587 |
| 4,701,624 | 10/1987 | Kern et al. | 250/554 |
| 4,769,775 | 9/1988 | Kern et al. | 364/551.01 |
| 4,785,292 | 11/1988 | Kern et al. | 340/578 |
| 4,866,420 | 9/1989 | Meyer, Jr. | 340/578 |

*Primary Examiner*—Glen R. Swann, III

*Attorney, Agent, or Firm*—Quarles & Brady

[57] ABSTRACT

The presence of a flame from a burner is determined by analyzing the signal produced by a radiation sensor aimed at a burner. Specifically, a Fourier transformation is applied to the signal producing amplitude values for a spectrum of component frequencies produced by changes in the power of the flame over time. A logarithmic value is derived for each of the amplitude values. The degree of linearity of the distribution of the component frequency logarithmic amplitude values provides an indication of the flame presence. Several parameters, including integrated linear error, linearity regression correlation and slope difference, provide an indication of the degree of linearity. A plurality of values for each of these parameters are produced during an interval of time. When a given percentage of the parameter values are above their respective thresholds the flame is determined to be present, whereas when another given percentage of the parameter values are below their respective threshold the flame is determined to be extinguished.

21 Claims, 4 Drawing Sheets

BURNER FLAME SENSING SYSTEM AND METHOD

BACKGROUND OF THE INVENTION

The present invention relates to flame sensors for use in conjunction with a boiler, furnace or similar combustion apparatus; and more particularly to such sensors which provide an indication presence and characteristics of a flame in a multiple burner system.

Large boilers and furnaces utilize several burners which produce a plurality of flames. An electronic control system for the burners often includes a mechanism for detecting the presence of the flame and for providing information about the flame characteristics. Such information is used in a control system to regulate safe operation of the burner. A flame scanner is incorporated in such control systems to detect the presence or absence of a burner flame in a single or multiple burner apparatus. When the burner is on and fuel is being ejected from the burner's throat, the scanner monitors the flame and produces a signal indicative of the condition, intensity and type of flame. It is therefore necessary for the flame scanner to be able to discriminate between flames from a burner to be scanned and the flames of adjacent burners and other background conditions.

Previous scanners utilized an optical sensor aimed at the flame to produce an electrical signal which was proportional in amplitude to the intensity of the light from the flame. The amplitude of the sensor signal, after band pass or high pass filtering, was relied upon to discriminate between on and off states of the burner flame. However, the magnitude of the signal is dependent upon a number of variables such as damper position, proximity of the flame to the sensor, type of fuel, and BTU content of the fuel. Similarly the other flames in a multiple burner system produce a widely varying background signal component in the sensor signal. A prominent problem with an amplitude dependent flame scanner is the varying magnitude of the sensor signal in the flame off and flame on states. As a consequence, the difference in sensor signal amplitude between the flame on and the flame off states often is too small in order to set reliable thresholds for discriminating between the flame states.

The failure of the scanner to be able to discriminate properly between the different flame states can result in the control system erroneously shutting down the entire burner or preventing the operator from starting the burner. In addition, an erroneous determination may occur due to the background signal component being interpreted incorrectly as indicating that the proximate burner being sensed is ignited. In such a situation, the proximate burner flame may be extinguished, but the flame scanner produces a signal to the control system indicating that the burner flame is on. This erroneous indication can result in the fuel valve remaining open allowing explosive fumes to accumulate in the burner chamber. Therefore, the control system must provide a mechanism for discriminating among signals produced by the burner flame to be sensed and those from other flames in a multiple burner system.

SUMMARY OF THE INVENTION

A flame analyzer detects radiation from a combustion apparatus to sense a characteristic of a flame, such as the presence of the flame for example. A sensor produces an electric signal indicative of the detected radiation. The signal is converted, by Fourier transformation in the preferred embodiment, into a plurality of amplitude levels representing the magnitudes of a spectrum of component frequencies present in the signal. These component frequencies are produced by changes in the power of a flame with time. The flame characteristic is determined by the shape of a distribution of the plurality of the component frequency amplitude levels.

Preferably, the characteristic is determined by deriving logarithmic values for the plurality of amplitude levels. The degree of linearity of a distribution of the logarithmic values of the component frequency amplitudes is calculated. The degree of linearity is defined by one or more parameters such as the integrated linear error, slope difference and linearity regression correlation.

In order to determine the presence of a flame, a series of values for each calculated parameter is compared to a separate threshold for that parameter. The amounts of values above and below the threshold are tabulated. In this preferred embodiment, the amounts of the parameter values that are below the respective thresholds are averaged to produce a first average. Similarly, the amounts of the parameter values that are above the respective thresholds are averaged to produce a second average.

When the first average exceeds a first reference level a determination is made that the flame is absent, whereas when the second average exceeds a second threshold level a determination is made that the flame is present.

The general object of the present invention is to provide an apparatus and method for determining a characteristic of a flame, which method is immune from the effects that proximity of the sensor to the flame, flue damper position, and the type of fuel and its BTU content have on the flame sensing.

Another object of the present invention is to provide a flame detection technique that is based on changes in the shape of the flame's flicker frequency spectrum component with time.

A further object is to analyze the frequency spectrum of the flame sensor signal, and specifically to analyze the linearity of a distribution of logarithmic values of the component frequency amplitudes.

DETAILED DESCRIPTION OF THE INVENTION

Figure 1:
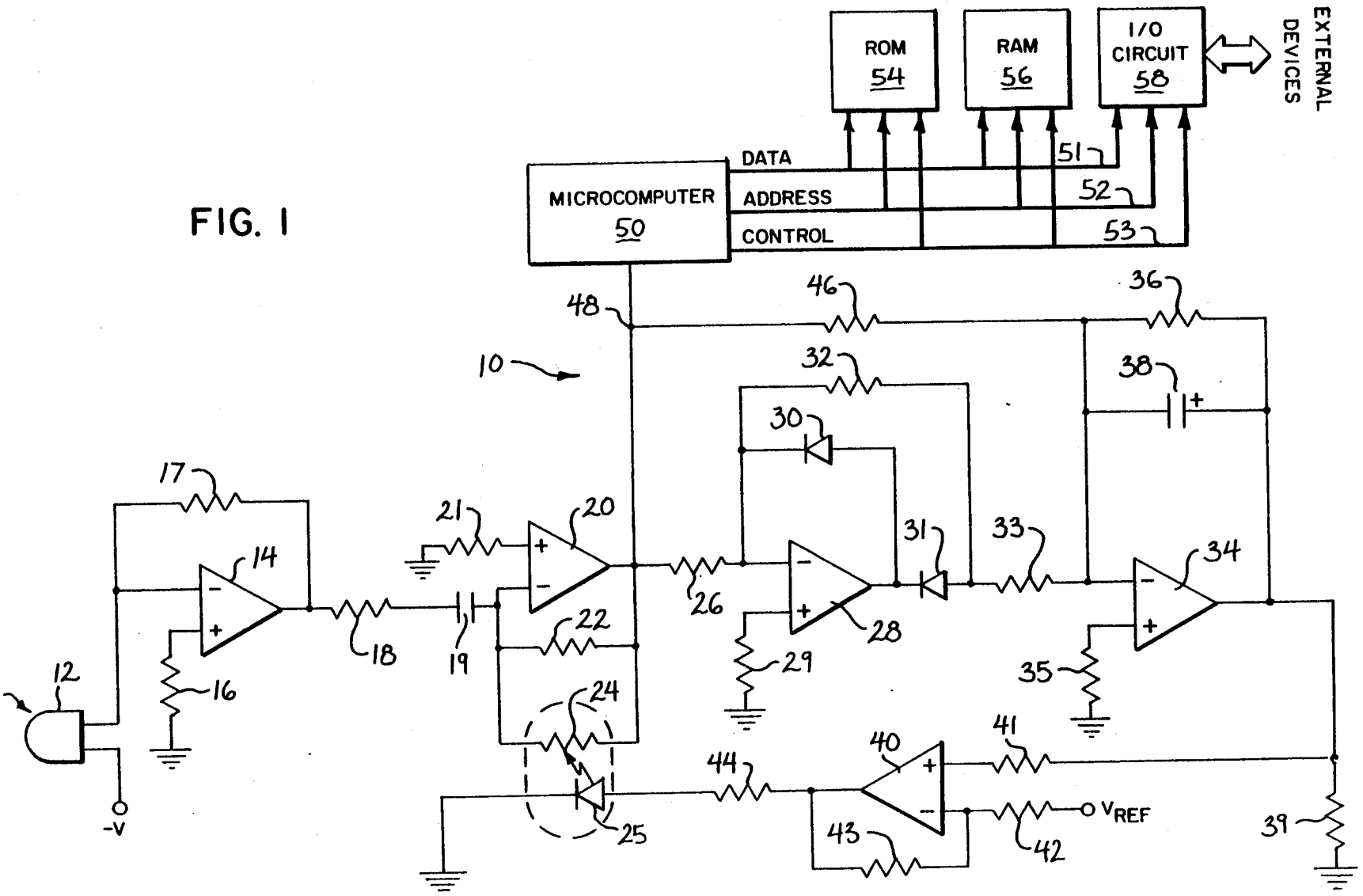
FIG. 1 is a diagram of the electronic circuitry of a flame analyzer which incorporates the present invention.

FIG. 1 represents an exemplary embodiment of the electronic circuitry for a burner flame analyzer 10 according to the present invention. A sensor 12, such as a lead sulfide detector, is positioned to receive the light radiation given off by a flame, which is to be detected. Although the sensor 12 is sighted so that it will receive the radiation from the desired flame, it typically also receives radiation from other flames in a multiple burner combustion apparatus. One lead of the sensor 12 is connected to a source of negative bias voltage (−V) and the other lead is connected to the inverting input of a fixed gain preamplifier 14. The non-inverting input of preamplifier 14 is coupled by a resistor 16 to circuit ground and the output of the preamplifier is connected by a feedback resistor 17 to its inverting input.

The output of the preamplifier 14 is coupled to an automatic gain control portion of the circuit comprising amplifier 20 and associated components. Specifically, the output of preamplifier 14 is coupled by a series connection of resistor 18 and capacitor 19 to the inverting input of a first amplifier 20. The capacitor 19 prevents the d.c. bias voltage applied to sensor 12 and the offset voltage of the preamplifier 14 from being applied to the first amplifier. The non-inverting input of amplifier 20 is coupled to the circuit ground by resistor 21. The output of the first amplifier 20 is coupled to its inverting input by a fixed resistor 22 and a photoresistor 24. The photoresistor 24 receives light from a light emitting diode 25 and the resistance of element 24 is inversely proportional to the current through the light emitting diode 25.

A resistor 26 couples the output from the first amplifier 20 to the inverting input of a second amplifier 28 whose non-inverting input is connected to ground by resistor 29. The second amplifier 28, diodes 30 and 31 and feedback resistor 32 provide full-wave rectification of the output signal from the first amplifier 20. The full-wave rectified signal is coupled by resistor 33 to a low-pass filter formed by a third amplifier 34, to which the rectified signal is applied at the inverting input. A resistor 35 connects the non-inverting input of the third amplifier 34 to ground. The output of the third amplifier 34 is coupled to its inverting input by the parallel connected combination of resistor 36 and capacitor 38. The low-pass filtering provides a d.c. signal that is proportional to the amplitude of the alternating signal from the first amplifier 20.

This d.c. signal is applied by resistors 39 and 41 to a non-inverting input of a differential amplifier 40. The differential amplifier 40 compares the output from the third amplifier 34 to a set point defined by a reference voltage $V_{REF}$ applied to the inverting input of the differential amplifier 40 by resistor 42. The output of the differential amplifier 40 is connected by a feedback resistor 43 to the non-inverting input. The output of the differential amplifier provides an error voltage that is proportional to the difference between the reference voltage $V_{REF}$ and the d.c. voltage from the third amplifier 34 which itself is proportional to the Signal output from the first amplifier 20.

The error voltage is converted into an error current signal by resistor 44 that is coupled to the anode of light emitting diode (LED) 25. This error current signal driving LED 25 provides negative feedback gain control of the first amplifier 20. As a result, as the a.c. amplitude of the signal from the preamplifier 14 decreases, the gain of the first amplifier 20 increases. The rate at which the gain of the control can change is defined by the time constant of the RC network formed by resistor 36 and capacitor 38 of the low-pass filter. This time constant is selected to be five times slower than the lowest frequency of interest used in the flame analysis. The design of the circuit provides five decades of gain control to maintain a good signal-to-noise ratio for a wide variety of flames produced by different flame types and firing conditions. The inverting input of the third amplifier 34 is coupled by resistor 46 to a node 48 at the output of the first amplifier 20. The node 48 forms the output of the automatic gain control amplifier circuit and is connected to an analog input of microcomputer 50. The microcomputer is an integrated circuit which in addition to containing a microprocessor, includes an analog-to-digital converter to which the analog input is connected. The microcomputer 50 also contains parallel input/output ports to which a set of data, address and control buses 51, 52 and 53 are respectively connected. In performing the flame analysis, as will be described, the microcomputer executes a program stored within a read only memory (ROM) 54. The data from the sensor 12, as represented by the signal received at the analog input of the microcomputer 50, are stored in a random access memory (RAM) 56. In addition, the random access memory 56 also provides storage locations for intermediate and final results of the analysis conducted by the microcomputer 50. The results of the processing are supplied to external devices, such as the burner control circuitry for the combustion apparatus, via an input/output interface circuit 58. The ROM 54, RAM 56 and input/output interface circuit 58 are coupled to the buses 51–53. During the operation of the flame analyzer 10 illustrated in FIG. 1, the sensor 12 converts the radiation from the burner assembly into an electrical signal. The output of sensor 12 is a time varying d.c. signal that is proportional to the power of the flame. The time varying portion of the signal is uncoupled from the d.c. component by capacitor 19 so that the output signal from the first amplifier 20 is equivalent to the differential change in the flame's power. This output signal is generated by what is commonly referred to as "flame flicker," i.e. the change in the shape or power of the flame with time. The flame flicker can be used to determine several characteristics of the flame such as its presence and stability.

The time varying portion of the sensor signal at node 48 is applied to the analog input of the microcomputer 50 and digitized into a ten bit digital number representing the magnitude of the analog signal. The microcomputer is interrupted on a regular interval to execute a software routine which samples the output of the analog-to-digital converter and stores the digital sample in a ring-type buffer located within RAM 56. For example, the microcomputer 50 is interrupted to acquire 300 flame signal samples per second and the ring buffer has 600 storage locations at which the periodically taken data samples are stored. Another memory location within RAM 56 stores a pointer to the memory location of the ring-type buffer at which the most recent digital number was stored. This pointer is used by subsequent data processing steps as an indication of where to enter the ring for data to be processed.

Figure 2A:
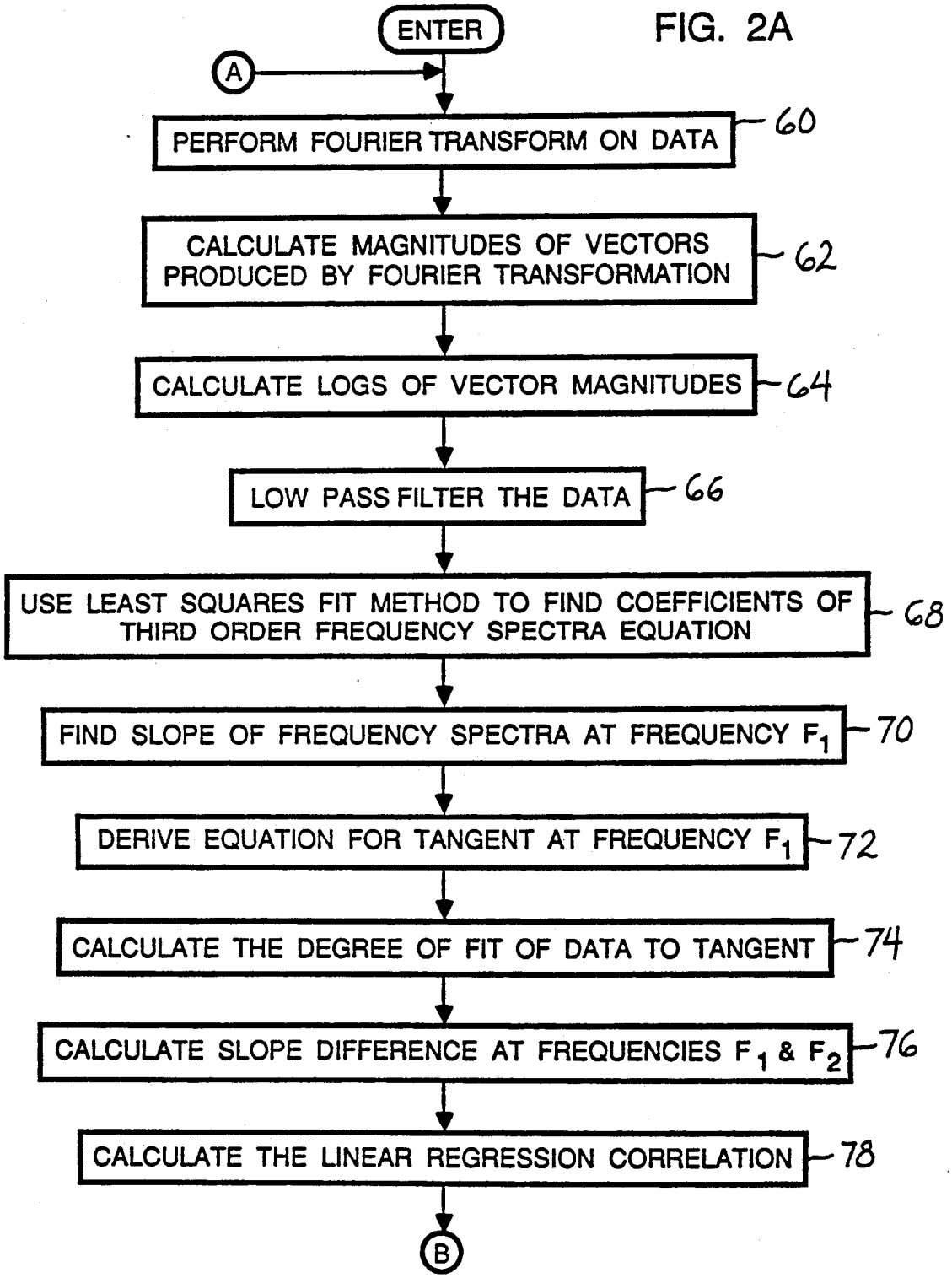
FIG. 2A and 2B form a flowchart of the flame analysis software.

Once the ring-type buffer contains 256 data samples, the microcomputer 50 begins continuously executing a background analysis task. With reference to FIG. 2A, the first step 60 of the analysis transforms the data stored in RAM 56 from the time domain to the frequency domain. In doing so, a conventional fast Fourier transform software routine is utilized to perform a 256 point transformation on the data samples to produce 128 complex numbers, representing frequency spectrum of the flame data from 0 to 149 Hertz in vector notation. These complex numbers are stored temporarily in RAM 56. Once the transformation is complete, the program execution advances to step 62 in which the microcomputer 50 calculates the magnitude of each complex frequency vector. This can be accomplished by taking the square root of the real part of the complex number squared plus the imaginary part squared. The magnitude of each vector represents the amplitude of a component frequency of the sensor signal. Although Fourier analysis is used to accomplish the transformation to the frequency domain, other techniques can be used. The logarithm to the base e for each of these amplitude values is calculated and stored within an array in RAM 56 at step 64. The logarithmic values are then digitally low pass filtered to provide a smoothing of that data at step 66.

Figure 3:
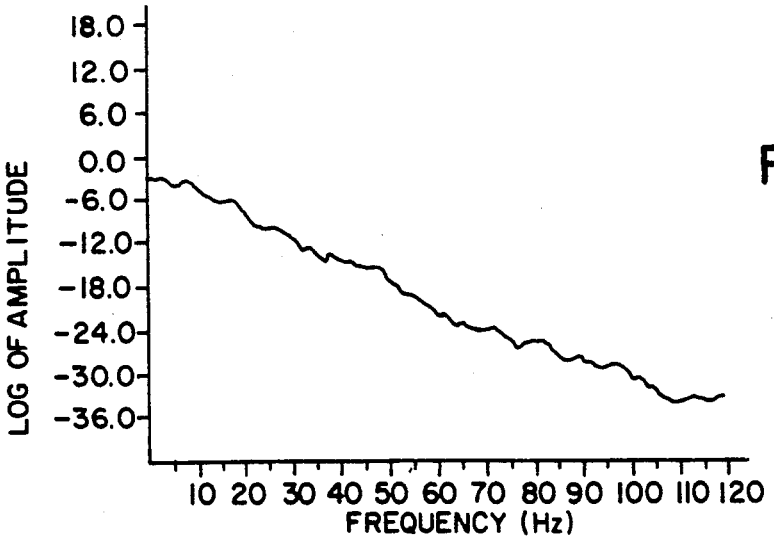
FIG. 3 is a spectrum of component frequencies of a signal produced by the flame analyzer in FIG. 1 for a stable burner flame.

FIG. 3 graphically represents a distribution of the logarithmic component frequency amplitude values for the sensor signal produced by an active flame. The component frequencies in the 0 to 149 Hertz spectrum are produced by changes in the shape of the flame with time, i.e. flame flicker. This graph indicates that amplitude decreases for higher frequencies in a mathematically predictable, ratiometric relationship. A generally linear relationship exists throughout the distribution of the logarithmic amplitude values.

Figure 4:
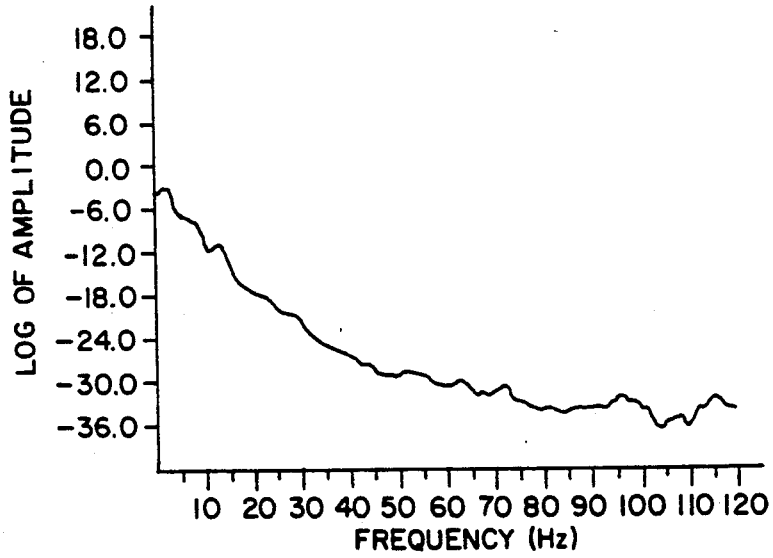
FIG. 4 is a spectrum, similar to that of FIG. 3, of the signal produced by the background radiation when the flame to be sensed is extinguished.

When the flame to be sensed is extinguished and the sensor 12 detects radiation from background sources, such as other flames of the multiple burner system, the distribution of the component frequency logarithmic amplitude values is similar to that graphically illustrated in FIG. 4. In this case, although the amplitude still decreases with frequency, the relationship of the logarithm of the amplitude values to frequency no longer is linear. Thus, there is a different mathematical relationship for the frequency spectrum data when the flame is present and when it is extinguished.

The flame presence, type and condition are determined by the microcomputer 50 from the shape of the frequency spectrum of the flame signal. Once the logarithms of the Fourier transformed amplitude values have been derived and stored in RAM 56, the change in logarithmic amplitude with frequency (the slope) is tested for continuity and uniformity over a predefined bandwidth (e.g. 0 to 100 Hertz). The degree of the continuity and uniformity is quantized to produce a number that is proportional to the flame's stability. It has been determined that the linearity of the spectrum is independent of both the flame signal amplitude which varies due to several factors, and the flame signal gain which corresponds to the flame power. Simply put, the flame size has no affect on the shape distribution of spectrum component frequencies. Therefore, the present system, which relies on the linearity of the spectrum rather than the amplitude of the flame signal from sensor 12, significantly minimizes the effects that damper position, fuel pressure, atomization pressure, fuel load rate, fuel to air ratio, BTU content, fuel type, and other variables have on the analysis. If the burner flame is on and relatively stable, a substantially linear and uniformly sloping distribution of component frequency amplitudes will be produced.

Since the ordinate of the graph in FIG. 3 is logarithmic, the spectrum for an ignited flame suggests that the sensor signal in the frequency domain can be represented by:

$$S(f)=Ae^{kf} \tag{1}$$

For a straight line, the log to the base e of this equation becomes:

$$Log[S(f)]=kf+Log[A] \tag{2}$$

where S(f) is the signal amplitude as a function of frequency, A is the amplitude in volts at zero Hertz (DC), e is the inverse natural log of one, k is the slope of the data (the decay constant), and f is the frequency in Hertz.

FIG. 4, representing the sensor signal component frequency distribution for an extinguished flame, shows a non-linear or piecewise linear plot of the logarithmic amplitude values versus frequency. A crude fit of this spectrum data suggests that sensor signal has the form:

$$S(f)=Ae^{af}+Be^{bf} \tag{3}$$

$$Log[S(f)]=af+Log[A]+bf+Log[B] \tag{4}$$

where "a" is the slope of the low frequency data and "b" is the slope of the high frequency data. In the flame off condition, coefficient "a" comes from low frequency black body or convection radiation and coefficient "b" comes from higher frequency white noise or other adjacent burner flames.

The remaining portion of the flame analysis program flow-charted in FIG. 2A determines the degree of linearity of the distribution of logarithmic amplitude values versus frequency. Commencing at step 68, the microcomputer 50 executes a routine which uses least squares techniques and determinants to fit the frequency spectrum data to a third order polynomial equation having the form:

$$s=a+bf+cf^2+df^3 \tag{5}$$

If the burner flame is on and stable, the frequency distribution decays linearly and coefficients c and d approach zero, leaving the equation of a straight line, $s_L=a+bf$. However, when the flame becomes unstable or goes out, coefficients c and d become more significant. These coefficients enable the determination of three parameters: integrated linear error (E), slope difference (md) and linearity regression correlation (R), which define the degree of slope continuity and uniformity.

Figure 5:
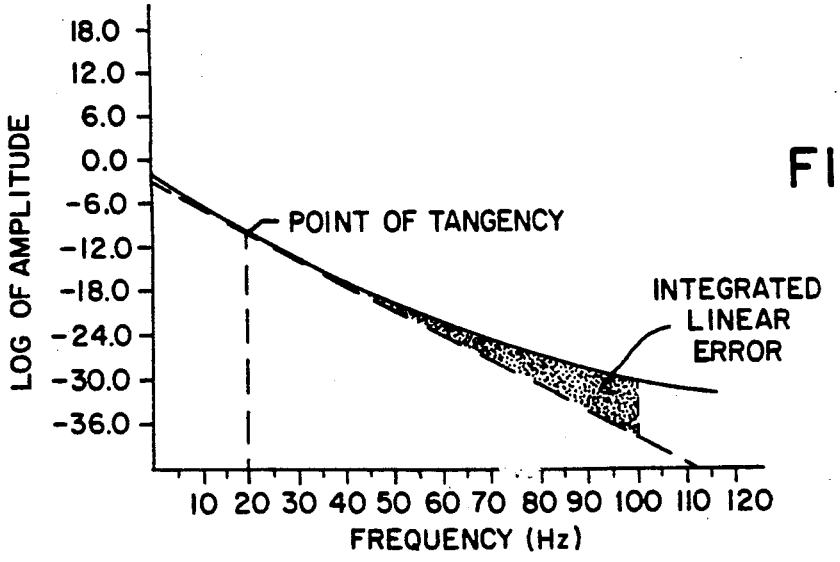
FIG. 5 is a graphical representation of one step in the flame signal analysis.

The first parameter, integrated linear error, determines whether the component frequency amplitude distribution can be satisfactorily described by a single slope coefficient. In determining this parameter, the derivative of the third order equation (5) is calculated at step 70 to find the slope at a relatively low first frequency $f_1$ (e.g. 20 Hertz). The slope is used at step 72 to derive the equation of the line tangential to the spectrum plot at the first frequency and the equation then is projected to determine its Y-axis intercept. This derivation produces the equation:

$$s_t=a_t+b_tf_1 \tag{6}$$

where $a_t$ is the intercept, and $b_t$ is the slope of the tangent line. This is graphically illustrated in FIG. 5 where the solid curve represents the component frequency amplitude values and the dashed line represents the tangent to the distribution of component frequency amplitudes at an $f_1$ of 20 Hertz.

If the distribution of the component frequency amplitude values throughout spectrum can be described satisfactorily by a single slope coefficient (i.e. the spectrum is linear), equation (6) for the tangent line should fit all of the component frequency amplitude values. The integrated linear error (E), or the degree of fit of the tangent line equation, is determined by finding the area between the curve of component frequency amplitude values and the tangent line from 0 to 100 Hertz. This area is given by the equation:

$$E = \int_0^{100} (s_t - s)df \tag{7}$$

which in terms of the third order polynomial coefficients is given by:

$$E = \left(a_t f + \frac{b_t f^2}{2}\right) - \left(af + \frac{bf^2}{2} + \frac{cf^3}{2} + \frac{df^4}{2}\right). \tag{8}$$

The integrated linear error (E) is calculated at step 74 and stored in RAM 56.

The execution of the analysis program in FIG. 2 then advances to step 76 where the second parameter, the slope difference, is calculated as another indication of frequency spectrum slope continuity. In doing so, the slope of the spectrum data is calculated at a second frequency (e.g. 80 Hertz) in the same manner as that used to calculate the slope at the first frequency point (20 Hertz). The difference between the two spectrum slopes is calculated and stored in RAM 56.

The final parameter indicative of the slope continuity and uniformity is the linearity regression correlation for the distribution of component frequency logarithmic amplitudes. For a given number n of paired data points in a two-dimensional array of data: $(f_1, s_1), (f_2, s_2), \ldots (f_n, s_n)$, the linearity regression correlation R is defined by the following expression:

$$R = \frac{n * \sum_{i=0}^{n-1} s_i f_i - \sum_{i=0}^{n-1} f_i * \sum_{i=0}^{n-1} s_i}{\sqrt{n * \left(\sum_{i=0}^{n-1} f_i^2 - \sum_{i=0}^{n-1} f_i\right) * \sum_{i=0}^{n-1} f_i * \sqrt{n * \left(\sum_{i=0}^{n-1} s_i^2 - \sum_{i=0}^{n-1} s_i\right) * \sum_{i=0}^{n-1} s}}}$$

where $s_i$ is the logarithmic amplitude of component frequency $f_i$. When the linearity regression correlation equals unity, there is perfect linearity and correlation. However, a linearity regression correlation value less than one indicates non-linearity and less correlation. The correlation value, calculated at step 78, is stored in the RAM 56.

Figure 2B:
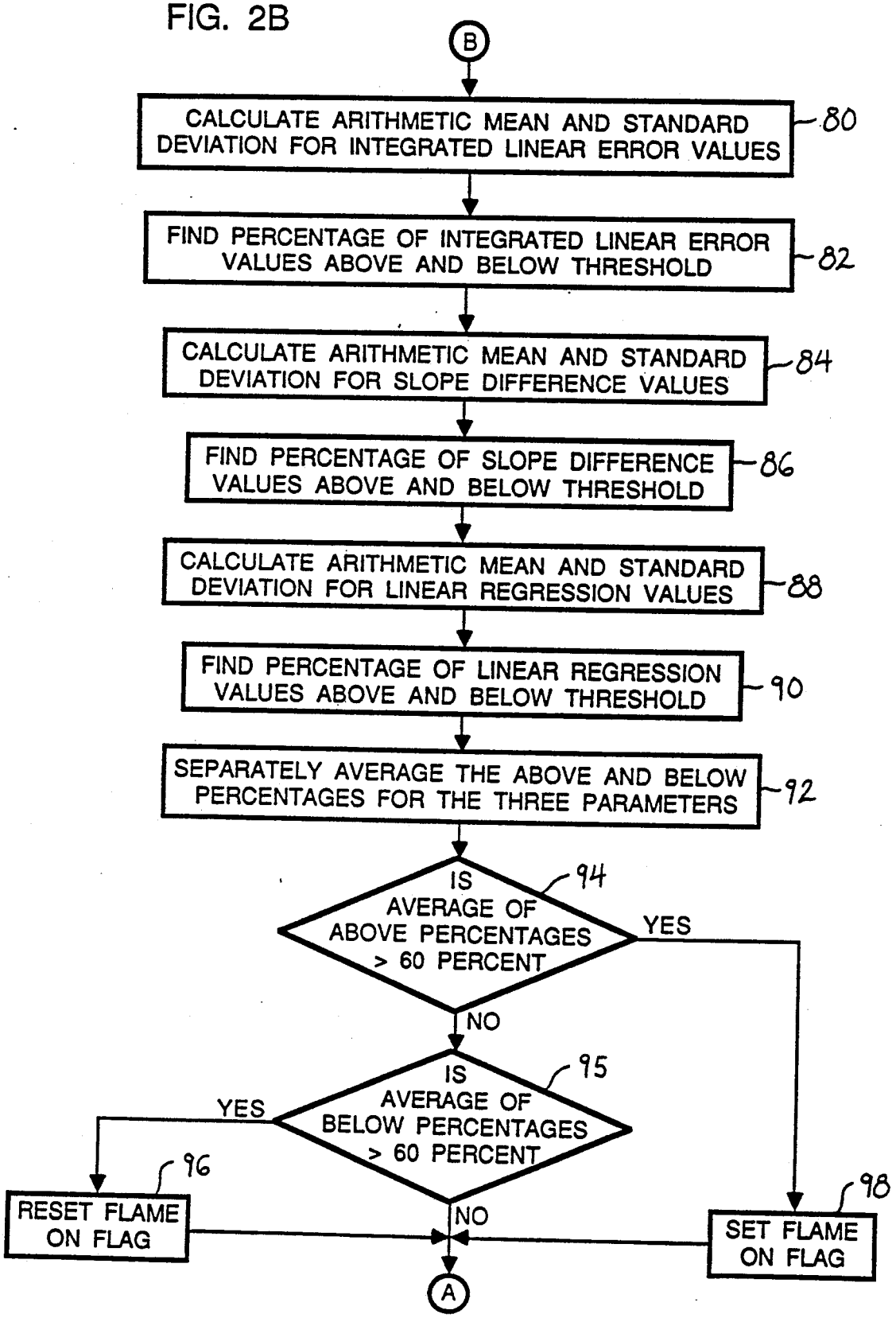

The remainder of the flame analysis background program commencing on FIG. 2B interprets the values of the three flame spectrum shape parameters in reaching a determination as to the presence of the flame and its stability. A new set of spectrum shape parameters are calculated several times per second due to a continuous looping of the background analysis program. A series of values for each parameter is saved in a separate ring type buffer within RAM 56. The size of each buffer is determined by a configuration parameter designated the flame failure response time (FFRT), which is set by the user. The FFRT defines the maximum amount of time that the analyzer 10 has to determine if the flame is on or off. The number of sample storage locations in each flame shape parameter buffer is equal to the FFRT multiplied by the number of fast Fourier transforms being taken per unit of time.

The data stored within each flame spectrum shape parameter buffer is averaged and the standard deviation computed. Each arithmetic mean and standard deviation defines a Gaussian distribution curve for the parameter. A statistical technique commonly referred to as the "Lower-Tail Test" is applied to determine the percentage of the data lying above and below a critical threshold for that parameter. Hysteresis about the shape parameter thresholds is provided by requiring that sixty percent of the data samples be above the threshold for a flame on determination to be reached, and by requiring sixty percent of the data samples to be below the threshold in order for a flame off determination.

With specific reference to the flowchart of the analysis program in FIG. 2B, at step 80 the arithmetic mean and standard deviation for the integrated linear error values stored within the corresponding ring buffers in RAM 56 are calculated by the microcomputer 50. Then these statistical values are employed to determine the percentages of the buffer values that lie above and below a predefined threshold for the integrated linear error. Similar statistical processing is performed at steps 84–86 and 88–90 to derive such percentages for the slope difference values and the linearity regression correlation values with respect to their separate thresholds. The resultant percentages are stored in RAM 56.

The parameter thresholds were determined empirically during set up of the analyzer 10 for a specific combustion apparatus. At that time, a flame is ignited and a series of flame spectrum analysis performed. The maximum values for the integrated linear error, slope difference, and linearity regression correlation parameters are found for this analysis series. Then the flame is extinguished and another series of flame spectrum analysis performed. The maximum and minimum values for the three linearity parameters then are found. The midpoint between the minimum and maximum values for each parameter becomes the parameter threshold.

Returning to the flame analysis program execution at step 92, the percentages of the three parameters values lying above their thresholds are averaged, and the percentages of the three parameters values lying below their thresholds are averaged The average of the "above" percentages is tested at step 94 to determine if it is greater than sixty percent, in which case the program execution branches to step 98 where a flag is set to indicate that the flame is on. The program execution then loops back to step 60 to perform the analysis once again using newly acquired data. If the averaged "above" percentages is not found at step 94 to be greater than sixty percent, the program advances to step 95. At this juncture the average of the "below" percentages is tested to determine if it is greater than sixty percent, in which case the program execution branches to step 96 where the flame-on flag is reset to indicate that the flame extinguished before returning to step 60. When neither of the tests conducted at steps 94 and 95 is true, the program returns directly to step 60 without altering the status of the flame-on flag and leaving its previously determined status intact.

Another background software routine periodically examines the flame-on flag and sends a signal indicative of the flag status via the I/O interface circuit 58 to the appropriate external devices.

I claim:

1. A flame analyzer comprising:

a sensor for detecting radiation produced by a flame and producing an electrical signal indicative of the radiation;

means for converting the electrical signal into a spectrum comprising a plurality of component frequencies of the electrical signal, the component frequencies resulting from changes in power of the flame with time, and wherein each component frequency has an amplitude;

means for determining a degree of linearity of a distribution of component frequency amplitudes throughout the spectrum; and means for determining a characteristic of the flame in response to the degree of linearity.

2. The flame analyzer as recited in claim 1 wherein said means for converting the electrical signal comprises means for performing a Fourier transformation on the electrical signal.

3. The flame analyzer as recited in claim 1 wherein said means for determining a degree of linearity comprises means for determining a difference between slopes of the distribution of component frequency amplitudes at at least two frequencies of the spectrum.

4. The flame analyzer as recited in claim 1 wherein said means for determining a degree of linearity comprises means for determining a linearity regression correlation (R) for the distribution of component frequency amplitudes as given by the expression:

$$R = \frac{n * \sum_{i=0}^{n-1} s_i f_i - \sum_{i=0}^{n-1} f_i * \sum_{i=0}^{n-1} s_i}{\sqrt{n * \left(\sum_{i=0}^{n-1} f_i^2 - \sum_{i=0}^{n-1} f_i\right) * \sum_{i=0}^{n-1} f_i} * \sqrt{n * \left(\sum_{i=0}^{n-1} s_i^2 - \sum_{i=0}^{n-1} s_i\right) * \sum_{i=0}^{n-1} s}}$$

where n is the number of component frequencies and $s_i$ is the amplitude of a component frequency $f_i$.

5. The flame analyzer as recited in claim 1 wherein said means for determining a degree of linearity comprises:

means for deriving data values for a set of the component frequencies, each data value being defined by an equation of a line tangent at a given point to the distribution of component frequency amplitudes; and means for integrating the difference between the amplitude produced by said means for converting and the data value for each member of the set of component frequencies to produce a first value indicative of the degree linearity.

6. The flame analyzer as recited in claim 5 wherein said means for determining a degree of linearity further comprises:

means for determining a difference between slopes of the distribution of component frequency amplitudes at two locations, wherein the difference is a second value indicative of the linearity of the spectrum; and means for determining a linearity regression correlation for the distribution of component frequency amplitudes wherein the linearity regression correlation is a third value indicative of the linearity of the spectrum.

7. The flame analyzer as recited in claim 6 wherein said means for determining a characteristic of the flame comprises:

a first means for comparing a plurality of the first values to a first threshold to determine amounts of the first values that are respectively above and below the first threshold;

a second means for comparing a plurality of the second values to a second threshold to determine amounts that are respectively above and below the second threshold;

a third means for comparing a plurality of the third values to a third threshold to determine amounts that are respectively above and below the third threshold;

first means for averaging the amounts of the first, second and third values below their respective thresholds to produce a first average;

second means for averaging the amounts of the first, second and third values above their respective thresholds to produce a second average; and means for producing an indication that the flame is extinguished when the first average exceeds a first reference value, and for producing and indication that the flame is present when the second average exceeds a second reference value.

8. An apparatus for detecting the presence of a flame comprising:

a sensor for detecting radiation produced by a flame and producing an electrical signal indicative of the radiation;

an automatic gain controlled amplifier for amplifying the electrical signal;

means for digitizing the electrical signal from said amplifier into a plurality of signal samples;

means for storing the plurality of signal samples;

means for transforming the signal samples from a time domain to a frequency domain to produce a plurality of component frequency amplitude values;

means for deriving a logarithmic value for each component frequency amplitude value of the electrical signal;

means for determining a degree of linearity of a distribution of the logarithmic values; and means for evaluating the degree of linearity to determine whether the flame is present.

9. The flame analyzer as recited in claim 8 wherein said means for determining a degree of linearity determines a difference between slopes at two locations along the distribution of the logarithmic values.

10. The flame analyzer as recited in claim 8 wherein said means for determining a degree of linearity determines a linearity regression correlation for the distribution of the logarithmic values.

11. The flame analyzer as recited in claim 8 wherein said means for determining a degree of linearity comprises:

means for defining a line tangent to a given point along the distribution of logarithmic values; and means for integrating a series of differences between the logarithmic values and points on the defined line thereby producing a first value indicative of the linearity of the logarithmic values.

12. The flame analyzer as recited in claim 11 wherein said means for determining a degree of linearity further comprises:

means for determining a difference between slopes at two locations on the distribution of logarithmic values to produce a second value indicative of the degree linearity; and means for determining a linearity regression correlation for the distribution of logarithmic values to produce a third value indicative of the degree of linearity.

13. The flame analyzer as recited in claim 12 wherein means for evaluating the degree of linearity comprises:

a first means for comparing a plurality of the first values to a first threshold to determine an amount of the first values below the first threshold and an amount of the first values above the first threshold;

a second means for comparing a plurality of the second values to a second threshold to determine an amount of the second values below the second threshold and an amount of the second values above the second threshold;

a third means for comparing a plurality of the third values to a third threshold to determine an amount of the third values below the third threshold and an amount of the third values above the third threshold;

first means for averaging the amounts of the first, second and third values below their respective thresholds to produce a first average;

second means for averaging the amounts of the first, second and third values above their respective thresholds to produce a second average; and means for producing an indication that the flame is extinguished when the first average exceeds a first reference value, and for producing and indication that the flame is present when the second average exceeds a second reference value.

14. A method for determining a characteristic of a flame comprising:

detecting radiation at a frequency produced by a flame and producing an electrical signal indicative of the radiation;

transforming the electrical signal from a time domain to a frequency domain to produce amplitude values for a plurality of component frequencies which result from shape changes of the flame with time;

determining a degree of linearity of a distribution of the amplitude values; and employing the degree of linearity to determine a flame characteristic.

15. The method as recited in claim 14 wherein said step of transforming the electrical signal comprises performing a Fourier transformation of the electrical signal.

16. The method as recited in claim 14 wherein said step of determining a degree of linearity comprises deriving a logarithmic value for each amplitude value; and determining a degree of linearity of a distribution of the logarithmic values.

17. The method as recited in claim 14 wherein said step of determining a degree of linearity comprises deriving a difference between slopes at two points on the distribution of the amplitude values.

18. The method as recited in claim 14 wherein said step of determining a degree of linearity comprises means for determining a linearity regression correlation for the distribution of the amplitude values.

19. The method as recited in claim 14 wherein said step of determining a degree of linearity comprises:

deriving data values for the component frequencies from an equation of a line tangent at a given point to the distribution of the amplitude values; and integrating the differences between an amplitude value and a data value for each component frequency in a given frequency band to produce a first value indicative of the degree of linearity.

20. The method as recited in claim 19 wherein said step of determining a degree of linearily further comprises:

determining a difference between slopes at two points on the distribution of amplitude values to produce a second value indicative of the degree of linearity; and determining a linearity regression correlation for the distribution of the amplitude values to produce a third value indicative of the degree of linearity.

21. The method as recited in claim 14 wherein said step of determining a degree of linearity comprises:

comparing a plurality of the first values to a first threshold to determine an amount of the first values that are below the first threshold and an amount of the first values that are above the first threshold;

comparing a plurality of the second values to a second threshold to determine an amount of the second values that are below the second threshold and an amount of the second values that are above the second threshold;

comparing a plurality of the third values to a third threshold to determine an amount of the third values that are below the third threshold and an amount of the third values that are above the third threshold;

averaging the amounts of the first, second and third values that are below their respective thresholds to produce a first average;

averaging the amounts of the first, second and third values that are above their respective thresholds to produce a second average; and wherein said step of employing the degree of linearity to determine a flame characteristic produces an indication that the flame is extinguished when the first average exceeds a first reference value, and produces and indication that the flame is present when the second average exceeds a second reference value.

* * * * *